US006773335B2

(12) United States Patent
Hakomori

(10) Patent No.: US 6,773,335 B2
(45) **Date of Patent: *Aug. 10, 2004**

(54) APPARATUS FOR POLISHING PERIPHERY OF DEVICE WAFER AND POLISHING METHOD

(75) Inventor: Shunji Hakomori, Kanagawa (JP)

(73) Assignee: Speedfam Co., Ltd., Kanagawa (JP)

( * ) Notice: Subject to any disclaimer, the term of this patent is extended or adjusted under 35 U.S.C. 154(b) by 55 days.

This patent is subject to a terminal disclaimer.

(21) Appl. No.: 10/116,327

(22) Filed: Apr. 4, 2002

(65) Prior Publication Data

US 2002/0164930 A1 Nov. 7, 2002

(30) Foreign Application Priority Data

May 2, 2001 (JP) ..... 2001-134977

(51) Int. Cl.[7] ..... B24B 7/19; B24B 1/00

(52) U.S. Cl. ..... 451/44; 451/57; 451/65; 451/324; 451/398

(58) Field of Search ..... 451/44, 43, 57, 451/246, 268, 324, 398, 325, 258, 254, 255, 256, 65

(56) References Cited

U.S. PATENT DOCUMENTS 3,187,467 A * 6/1965 Cortesi ..... 451/151
5,725,414 A * 3/1998 Moinpour et al. ..... 451/41
6,159,081 A * 12/2000 Hakomori ..... 451/57
6,248,005 B1 * 6/2001 Ozaki ..... 451/254
6,332,834 B1 * 12/2001 Nukui et al. ..... 451/57
6,334,808 B1 * 1/2002 Tanaka ..... 451/44
6,422,930 B2 * 7/2002 Hakomori ..... 451/325
6,478,660 B2 * 11/2002 Hakomori et al. ..... 451/44

FOREIGN PATENT DOCUMENTS

| | | |
|---|---|---|
| JP | 09-186234 | 7/1997 |
| JP | 10-312981 | 11/1998 |
| JP | 2000-068273 | 3/2000 |

* cited by examiner

*Primary Examiner*—Hadi Shakeri
(74) *Attorney, Agent, or Firm*—Snell & Wilmer, LLP

(57) ABSTRACT

When a device wafer is chucked and is rotated about an axis thereof, arc-shaped work faces of first and second inclined-face-polishing members are brought into line-contact with inclined faces disposed at front and rear faces, respectively, of the device wafer, the arc-shaped work face of a peripheral-face-polishing member is brought into line-contact with a peripheral face of the device wafer, and a disc-shaped work face of a peripheral-edge-polishing member is brought into planar contact with the front face of the device wafer at a peripheral edge thereof, whereby the inclined faces, the peripheral face, and the peripheral edge are polished simultaneously by the respective polishing members. Thus, an unnecessary part of a metallic film is removed from the periphery of the device wafer.

11 Claims, 7 Drawing Sheets

APPARATUS FOR POLISHING PERIPHERY OF DEVICE WAFER AND POLISHING METHOD

BACKGROUND OF THE INVENTION

1. Field of the Invention

The present invention relates to a technology for removing, by polishing, an unnecessary part of a metallic film from the periphery of a device wafer which is provided with the metallic film on a surface thereof.

2. Description of the Related Art

In FIG. 10, a semiconductor wafer 1, which is a so-called device wafer, is shown. The wafer 1 is disc-shaped and includes inclined faces 2*a* and 2*b*, which are formed by chamfering the wafer 1 at both sides of the periphery thereof, and a peripheral face 3 disposed between the inclined faces 2*a* and 2*b*. The wafer 1 is provided with a metallic film 4 deposited on the wafer 1 from the inclined face 2*a* disposed at a front face of the wafer 1 to the peripheral face 3 and the inclined face 2*b* which is disposed at a rear face of the wafer 1.

In the device wafer 1, a part n of the metallic film 4 disposed at the periphery of the wafer is not necessary. The part n is likely to be removed by being brought into contact with a chuck during the transportation of the wafer, which causes dust or produces a defective product; therefore, various methods have been used for removing the part n. In this case, it is important to form a perpendicular end 4*a* of the remaining metallic film 4, as shown in FIG. 11. When the end 4*a* is inclined, as shown by a dotted line, the metallic film 4 is easily removed at this part.

A method for removing the unnecessary part of a metallic film is disclosed in, for example, Japanese Patent No. 3111928, in which a wafer rotating about an axis thereof is pressed onto a polishing pad at the periphery of the wafer, whereby a part of a metallic film disposed at the periphery and toward the rear face of the wafer is removed by varying the angle of the polishing pad. However, the end of the metallic film becomes inclined with the metallic film being cut in an oblique direction by the polishing pad and cannot be formed perpendicularly. Since the angle of the polishing pad must be varied in order to polish the overall surface of the periphery of the wafer, there is a drawback in that a driving mechanism having a complex structure is required and polishing is performed inefficiently over a long time.

Other methods for removing the unnecessary part of the metallic film disposed at the periphery of a wafer are disclosed in, for example, Japanese Unexamined Patent Application Publication No. 9-186234, one of which involves the wafer being polished such that a belt-shaped polishing cloth wraps around the wafer which rotates about an axis thereof and is pressed onto the wafer at the periphery thereof. In another method, the wafer is polished in such a manner that the polishing pad is fixed to a disc-shaped stage which rotates about an axis thereof and the periphery of the rotating wafer is pressed onto the polishing pad at a right angle such that a part of the wafer is pushed into the polishing pad.

However, in these methods, the belt-shaped polishing pad or the disc-shaped polishing pad comes into contact with the surface of the wafer in an oblique direction. Therefore, the end of the metallic film is cut in the oblique direction and cannot be formed perpendicularly.

For example, in Japanese Unexamined Patent Application Publication No. 2000-68273, a method for removing the metallic film disposed at the periphery of a front face of a wafer is disclosed, in which the wafer is polished by a rotating drum-shaped polishing head being pressed onto the periphery of the front face of the wafer which rotates about an axis thereof. However, the metallic film 4 of the wafer 1 shown in FIG. 10 disposed on the inclined faces 2*a* and 2*b* and the peripheral face 3 cannot be removed by this method except for the metallic film disposed at the periphery of the front face of the wafer. As a result, efficiency of the operation is deteriorated and scars due to a chuck are likely to occur because the wafer must be repeatedly chucked by the chuck.

SUMMARY OF THE INVENTION

Accordingly, it is an object of the present invention to provide a technology for removing an unnecessary part of a metallic film from the periphery of a device wafer, so as to efficiently form a perpendicular end of the metallic film by once chucking the device wafer using polishing members for polishing the device wafer at inclined faces formed with both sides of the periphery of the device wafer being chamfered, a peripheral face disposed between the inclined faces, and the peripheral edge of a front face of the device wafer in one process stage.

To this end, according to the present invention, a polishing apparatus for polishing a periphery of a device wafer is provided, which comprises a chuck table which chucks the device wafer provided with a metallic film deposited on inclined faces formed by chamfering both sides of the device wafer at the periphery thereof, a peripheral face disposed between the inclined faces, and a front face of the device wafer, and which rotates the device wafer about the axis thereof at a predetermined speed; a first inclined-face-polishing member and a second inclined-face-polishing member each having an arc-shaped work face and an axis which is inclined with respect to an axis of the device wafer, the work face of the first inclined-face-polishing member being positioned so as to come into line-contact with the inclined face disposed at the front face of the device wafer and the work face of the second inclined-face-polishing member being positioned so as to come into line-contact with the inclined face disposed at a rear face of the device wafer; a peripheral-face-polishing member having an arc-shaped work face and an axis which is parallel to the axis of the device wafer, the work face being positioned so as to come into line-contact with the peripheral face of the device wafer; and a peripheral-edge-polishing member formed as a disc rotatable about an axis thereof either perpendicular or parallel to the axis of the device wafer, a work face of the peripheral-edge-polishing member being positioned so as to come into planar contact with the front face of the device wafer at a peripheral edge thereof.

In the polishing apparatus according to the present invention, as described above, the inclined faces, the peripheral face, and the peripheral edge disposed at the periphery of the wafer held by a chuck are polished by the inclined-face-polishing members, the peripheral-face-polishing member, and the peripheral-edge-polishing member, respectively, whereby the wafer can be polished at the overall surface of the periphery thereof by once chucking the wafer, thereby suppressing damages due to chucking to a lowest level. Since the inclined-face-polishing members and the peripheral-face-polishing member are individually provided with arc-shaped work faces which come into line-contact with the inclined faces and the peripheral face, respectively, for polishing, the polishing can be performed efficiently in a short time. Since the peripheral-edge-polishing member comes into planar contact with the front face of the wafer at the peripheral edge thereof, the metallic film can be removed so that the end thereof is formed perpendicularly.

According to an embodiment of the present invention, the polishing apparatus may further comprise at least one feed mechanism for moving the inclined-face-polishing members and the peripheral-face-polishing member, each in a direction parallel to the axis thereof; at least one linear guide mechanism for supporting the inclined-face-polishing members and the peripheral-face-polishing member, each being movable in a direction perpendicular to the axis thereof; and at least one load-applying mechanism for bringing the inclined-face-polishing members and the peripheral-face-polishing member into contact with the wafer, each at a predetermined pressure.

The polishing apparatus may further comprise a first guide mechanism for supporting the peripheral-edge-polishing member movable in directions toward and away from the device wafer; a load-applying mechanism for bringing the peripheral-edge-polishing member into contact with the front face of the device wafer at a predetermined pressure; and a second guide mechanism for moving the peripheral-edge-polishing member in a radial direction of the device wafer so that the width of the metallic film to be removed is controlled, and a driving source.

According to another embodiment of the present invention, the first inclined-face-polishing member and the second inclined-face-polishing member may be disposed so as to oppose each other and the peripheral-face-polishing member, and the peripheral-edge-polishing member may be disposed so as to oppose each other in a direction differing by ninety degrees from the direction in which the first inclined-face-polishing member and the second inclined-face-polishing member oppose each other.

According to the embodiment of the present invention, the second guide mechanism for the peripheral-edge-polishing member may comprise a supporting table which is movable along an apparatus body in the radial direction of the device wafer and a driving source for driving the supporting table, the first guide mechanism may be formed such that the supporting table supports a supporting frame which holds the peripheral-edge-polishing member so that the supporting frame is movable in the directions toward and away from the device wafer, and the load-applying mechanism may be connected to the supporting frame and may function to reduce a sum of the load of the supporting frame and components mounted thereon, thereby applying the reduced load as a work load to the device wafer.

According to the present invention, the work face of the peripheral-edge-polishing member may be provided at the periphery of the peripheral-edge-polishing member and be formed as a short cylinder which has a uniform diameter and a length in the axial direction greater than the width of the metallic film to be removed, the work face being rotatable about the axis perpendicular to the axis of the device wafer.

The work face of the peripheral-edge-polishing member may be flat, be provided on a surface of at least the peripheral edge of the peripheral-edge-polishing member, may have a width in the radial direction greater than the width of the metallic film to be removed, and may be rotatable about the axis parallel to the axis of the device wafer.

According to the present invention, a method for polishing a periphery of a device wafer comprises the steps of chucking and rotating the device wafer about an axis thereof at a predetermined speed, the device wafer being provided with a metallic film deposited on inclined faces formed with by chamfering both sides of the device wafer at the periphery thereof, a peripheral face disposed between the inclined faces, and a front face of the device wafer; bringing an arc-shaped work face of a first inclined-face-polishing member into line-contact with the inclined face disposed at the front face of the device wafer and the arc-shaped work face of a second inclined-face-polishing member into line-contact with the inclined face disposed at a rear face of the device wafer, the first and second inclined-face-polishing members being each inclined with respect to the axis of the device wafer; bringing the arc-shaped work face of a peripheral-face-polishing member into line-contact with the peripheral face of the device wafer, the peripheral-face-polishing member being parallel to the axis of the device wafer; and bringing a disc-shaped work face of a peripheral-edge-polishing member into planar contact with the front face of the device wafer at a peripheral edge thereof, the peripheral-edge-polishing member rotating about an axis thereof either perpendicular or parallel to the axis of the device wafer. The inclined faces, the peripheral face, and the peripheral edge of the device wafer are polished simultaneously by the respective polishing members, whereby an unnecessary part of the metallic film is removed from the vicinity of the periphery of the device wafer.

DESCRIPTION OF THE PREFERRED EMBODIMENTS

Figure 10:
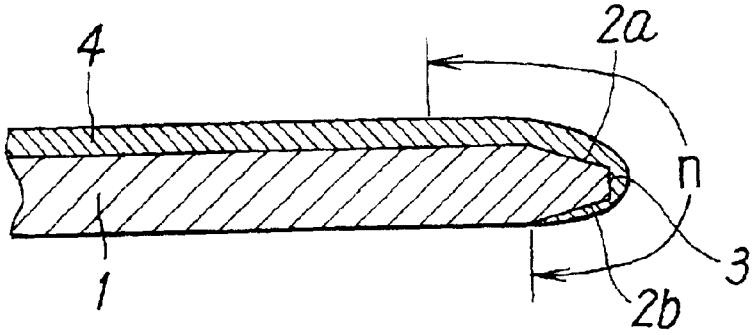
FIG. 10 is a sectional view of a critical portion of a device wafer to be polished.
Figure 11:
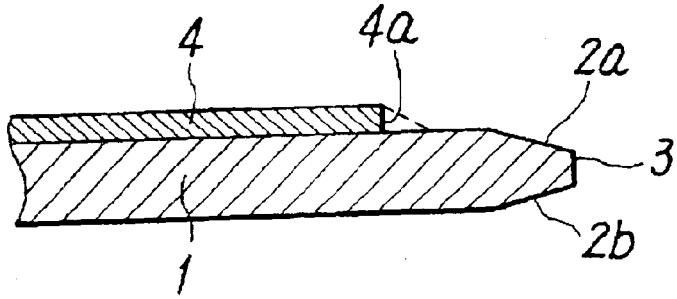
FIG. 11 is a sectional view of the critical portion of the device wafer from which an unnecessary part of a metallic film has been removed.

A periphery-polishing apparatus according to preferred embodiments of the present invention is described below in detail with reference to the drawings. FIGS. 1 to 4 show a first embodiment of the present invention. A polishing apparatus according to the first embodiment includes a chuck unit 12 for chucking a disc-shaped device wafer 1 shown in FIG. 10, a pair of inclined-face-polishing members 13*a* and 13*b* for polishing inclined faces 2*a* and 2*b* of the wafer 1 formed with both sides of the wafer 1 being chamfered at the periphery thereof, a peripheral-face-polishing member 14 for polishing a peripheral face 3, and a peripheral-edge-polishing member 15 for polishing a peripheral edge of a front face of the wafer 1.

The inclined faces 2*a* and 2*b* and the peripheral face 3 are not necessarily polished absolutely flat and may be each a convexly curved face.

Figure 2:
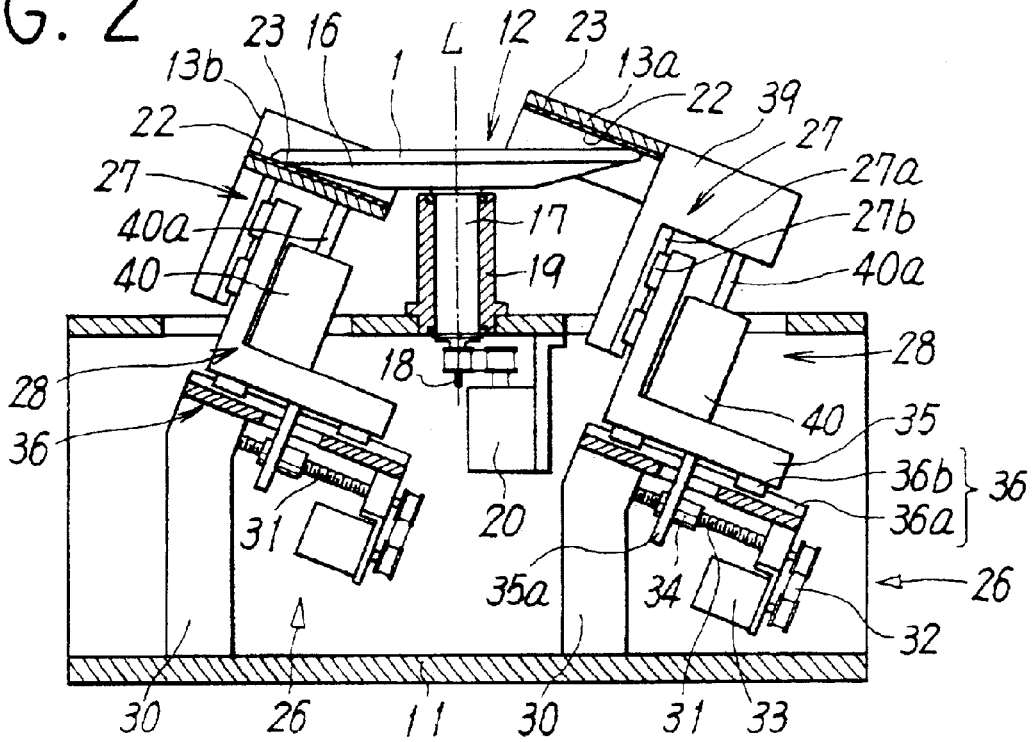
FIG. 2 is a sectional view of an inclined-face-polishing system along line II—II shown in FIG. 1.

The chuck unit 12 shown in FIG. 2 includes a chuck table 16 which has a diameter slightly smaller than that of the wafer 1 and can hold the wafer 1 horizontal on the chuck table 16 by vacuum attraction such that the periphery of the wafer 1 projects laterally from the chuck table 16. A plurality of attraction holes are formed in the upper surface of the chuck table 16, the attraction holes communicating with a vacuum pump (not shown) via a flow path formed in a main shaft 17 and a connection port 18. The main shaft 17 is supported rotatable about a vertical axis L via a bearing 19 on an apparatus body 11. The main shaft 17 can be driven for rotation in the forward or backward direction, as desired, by a motor 20 at a predetermined speed.

The method for chucking the wafer 1 at the chuck table 16 is not limited to the vacuum attraction, and other convenient methods such as electrostatic chucking by electrostatic attraction may be used.

Figure 1:
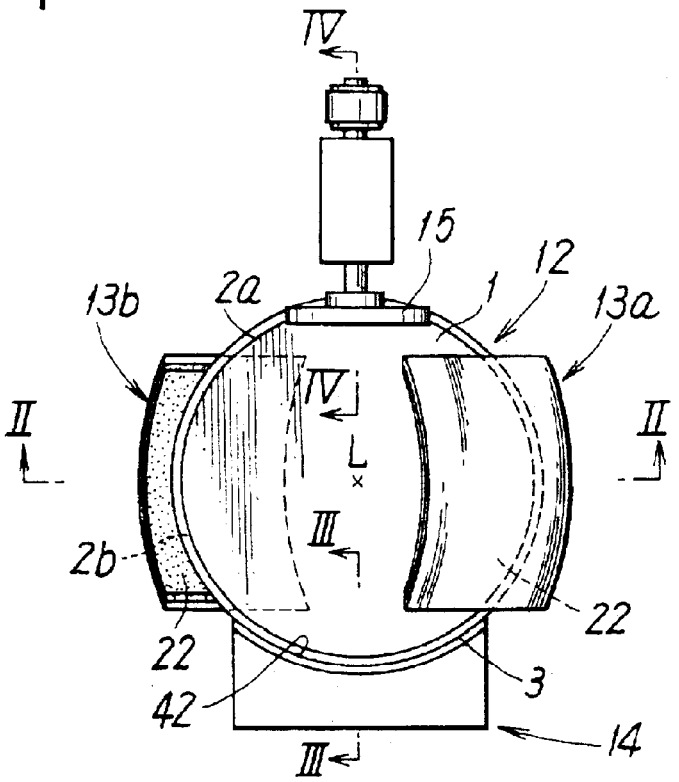
FIG. 1 is a schematic plan view showing the relationship of positions between a wafer and polishing members disposed in a polishing apparatus according to the present invention.

The inclined-face-polishing members 13*a* and 13*b* are individually provided with concave arc-shaped work faces 22 to come into line-contact with the periphery of the wafer 1, each work face 22 having arc-shaped recession formed in a hard substrate made of a metal, a synthetic resin, a ceramic, or the like. A flexible polishing pad 23 is bonded to the inner surface of the recession. Although each work face 22 is not provided with a concave groove along the arc for polishing, with which a wafer mates, the work face 22 may be provided with a plurality of grooves, for smooth flow of polishing slurry, being parallel and inclined with respect to the axis of the polishing member. The inclined-face-polishing members 13*a* and 13*b* having substantially the same configuration as each other are positioned opposing each other in a radial direction of the wafer 1 with the wafer 1 held by the chuck unit 12 therebetween, as shown in FIG. 1. The axes of the inclined-face-polishing members 13*a* and 13*b* are individually inclined with respect to the axis L, whereby the work face 22 of the first inclined-face-polishing member 13*a* is in contact with the inclined face 2*a* disposed at the front face of the wafer 1 at the overall width of the inclined face 2*a* and the work face 22 of the second inclined-face-polishing member 13*b* is in contact with the inclined face 2*b* disposed at the rear face of the wafer 1 at the overall width of the inclined face 2*b*. In this case, the work faces 22 of the polishing members 13*a* and 13*b* are in line-contact with the peripheral inclined faces 2*a* and 2*b*, respectively, of the wafer 1, and polish the inclined faces 2*a* and 2*b*, respectively.

Although the length of the arc of the work face 22 of each of the polishing members 13*a* and 13*b* shown in the drawing is approximately ¼ of the circumference of the wafer 1, the arc of the work face 22 or a work face 42 of the peripheral-face-polishing member 14 is preferably as longer as possible for improving the polishing efficiency with the increased length of contact with the wafer 1 unless the work face 22 or 42 interferes with the peripheral-edge-polishing member 15.

The curvature of the arc of the work face 22 of each of the polishing members 13*a* and 13*b* may be substantially the same as the curvature of the circumference of the wafer 1. However, the curvature of the arc of the work face 22 is preferably slightly smaller than that of the circumference of the wafer 1 so that the inclined work face 22 is reliably brought into line-contact with the periphery of the wafer 1.

The polishing apparatus includes feed mechanisms 26 for individually feeding the inclined-face-polishing members 13*a* and 13*b* in directions parallel to the axes thereof, that is, each in a direction substantially parallel to the inclination of the inclined face 2*a* or 2*b*, linear guide mechanisms 27 for individually supporting the inclined-face-polishing members 13*a* and 13*b* movable in directions perpendicular to the axes thereof, that is, each in directions toward and away from the inclined face 2*a* or 2*b*, and load-applying mechanisms 28 for applying a polishing load by individually urging the polishing members 13*a* and 13*b* in directions toward the inclined faces 2*a* and 2*b*, respectively.

The feed mechanisms 26 move the polishing members 13*a* and 13*b* toward and away from the wafer 1 when the polishing operation starts, is completed, or the like, or so that the contact positions of the polishing members with the wafer 1 are changed during polishing. Each feed mechanism 26 includes a ball screw 31 disposed on a bracket 30 fixed to the apparatus body 11, the ball screw 31 being parallel to the axis of the polishing member 13*a* or 13*b*, a motor 33 for rotating the ball screw 31 via a timing belt 32, a nut 34 coupled with the ball screw 31 and capable of moving forward and backward with the rotation of the ball screw 31, a movable table 35 which is connected to the nut 34 via an arm 35*a* and moves with the nut 34, and a sliding mechanism 36 for movably supporting the movable table 35. Each of the polishing members 13*a* and 13*b* is supported by the movable table 35 via the linear guide mechanism 27. The sliding mechanism 36 includes a rail 36*a* disposed on the bracket 30 and in parallel to the ball screw 31 and a slider 36*b* which is mounted to the movable table 35 and slides on the rail 36*a*.

Each linear guide mechanism 27 includes a rail 27*a* extending perpendicular to the axis of the polishing member 13*a* or 13*b*, the rail 27*a* being mounted to a holder 39 for holding the polishing member 13*a* or 13*b*, and a slider 27*b* which is mounted to the movable table 35 and is movable on the rail 27*a*. However, inversely to the case described above, the rail 27*a* and the slider 27*b* may be mounted to the movable table 35 and the holder 39, respectively.

Each load-applying mechanism 28 includes an air cylinder 40. The air cylinder 40 is mounted to the movable table 35 and a piston rod 40*a* is connected to the polishing member 13*a* or 13*b* side. The piston rod 40*a* extends or withdraws with pressure-controlled compressed air being supplied into or discharged from the air cylinder 40, whereby the polishing members 13*a* and 13*b* are pressed onto the wafer 1 and a predetermined polishing load of the polishing members 13*a* and 13*b* is applied to the wafer 1 by the controlled air pressure.

With this arrangement, the inclined-face-polishing members 13*a* and 13*b* shown in FIG. 2 can move along the axes thereof to the right or to the left with the rotation of the ball screws 31 of the respective feed mechanisms 26, whereby the positions of the work faces 22, which is in contact with the wafer 1 during polishing or when polishing starts, can be conveniently changed. In this case, the air cylinders 40 of the load-applying mechanisms 28 are controlled in accordance with the movement of the polishing members 13*a* and 13*b* and the length of extension of each piston rod 40*a* is controlled so that a predetermined polishing load is obtained. When the polishing operation starts or is completed, the first polishing member 13*a* is moved to the right and the second polishing member 13*b* is moved to the left, whereby the polishing members 13*a* and 13*b* separate from the wafer 1, and the wafer 1 can be supplied to or be removed from the chuck unit 12. In this case, only the first polishing member 13*a* in contact with the inclined face 2*a* disposed at the front face (upper face) may be moved to a position at which the polishing member 13*a* separates from the wafer 1 with the operation of the feed mechanism 26 while the second polishing member 13*b* in contact with the inclined face 2*b* disposed at the rear face (lower face) is maintained in that position or the piston rod 40*a* of the load-applying mechanism 28 is withdrawn so that the second polishing member 13*b* separates from the inclined face 2*b*.

Figure 3:
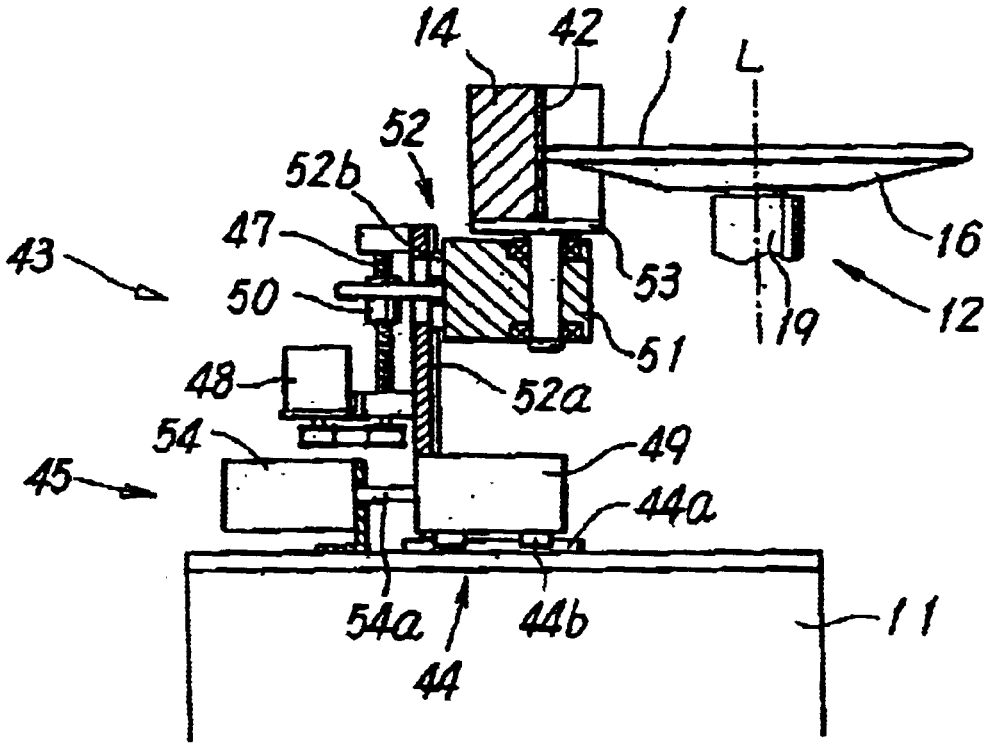
FIG. 3 is a sectional view of the inclined-face-polishing system along line III—III shown in FIG. 1.

The peripheral-face-polishing member 14 shown in FIG. 3 includes the work face 42 having substantially the same configuration as that of the inclined-face-polishing member 13*a* or 13*b*. That is, the work face 42 is concave-arc-shaped and is not provided with a concave groove for polishing. The peripheral-face-polishing member 14 is disposed between the two inclined-face-polishing members 13*a* and 13*b* with the axis of the peripheral-face-polishing member 14 being parallel to the axis L of the wafer 1. The work face 42 comes into contact with the wafer 1 at a right angle so as to be in line-contact therewith for polishing the peripheral face 3 (see FIG. 10).

The length of the arc of the work face 42 of the peripheral-face-polishing member 14 is set to approximately ¼ of the circumference of the wafer 1 in the drawing. However, the length of the arc of the work face 42 is preferably as long as possible, as described above, in order to increase the length of contact with the wafer 1 and to improve polishing efficiency. The curvature of the work face 42 is preferably the same as the curvature of the circumference of the wafer 1.

The peripheral-face-polishing member 14 is provided with a feed mechanism 43 for moving the polishing member 14 in a direction parallel to the axis thereof, a linear guide mechanism 44 for supporting the polishing member 14 movable in a direction perpendicular to the axis thereof, and a load-applying mechanism 45 for applying a polishing load with the polishing member 14 being urged toward the wafer The feed mechanism 43 includes a ball screw 47 extending parallel to the axis of the polishing member 14, a motor 48 for rotating the ball screw 47, a movable table 49 for supporting the ball screw 47 and the motor 48, a nut 50 coupled with the ball screw 47 and capable of moving forward and backward with the rotation of the ball screw 47, a supporting member 51 connected to the nut 50 and capable of moving together with the nut 50, and a sliding mechanism 52 for guiding the movement of the supporting member 51. The polishing member 14 is mounted to the supporting member 51 via a holder 53. The sliding mechanism 52 includes a rail 52*a* disposed on the movable table 49 in parallel to the ball screw 47 and a slider 52*b* which is mounted to the supporting member 51 and slides on the rail 52*a*.

The linear guide mechanism 44 includes a rail 44*a* which is disposed on the apparatus body 11 and extends perpendicular to the axis of the polishing member 14 and a slider 44*b* which is mounted to the movable 49 and is capable of moving on the rail 44*a*.

The load-applying mechanism 45 includes an air cylinder 54. The air cylinder 54 is mounted on the apparatus body 11 and is provided with a piston rod 54*a* connected to the movable table 49, thereby applying a predetermined polishing load with air pressure to the wafer 1 via the polishing member 14.

With this arrangement, the peripheral-face-polishing member 14 shown in FIG. 3 can change the position of the work face 42 in contact with wafer 1 during polishing or when polishing starts, by driving the feed mechanism 43 so as to move vertically. When polishing starts or is completed, the wafer 1 can be supplied to or be removed from the chuck unit 12 with the piston rod 54*a* of the air cylinder 54 of the load-applying mechanism 45 being withdrawn so that the polishing member 14 separates from the wafer 1.

Figure 4:
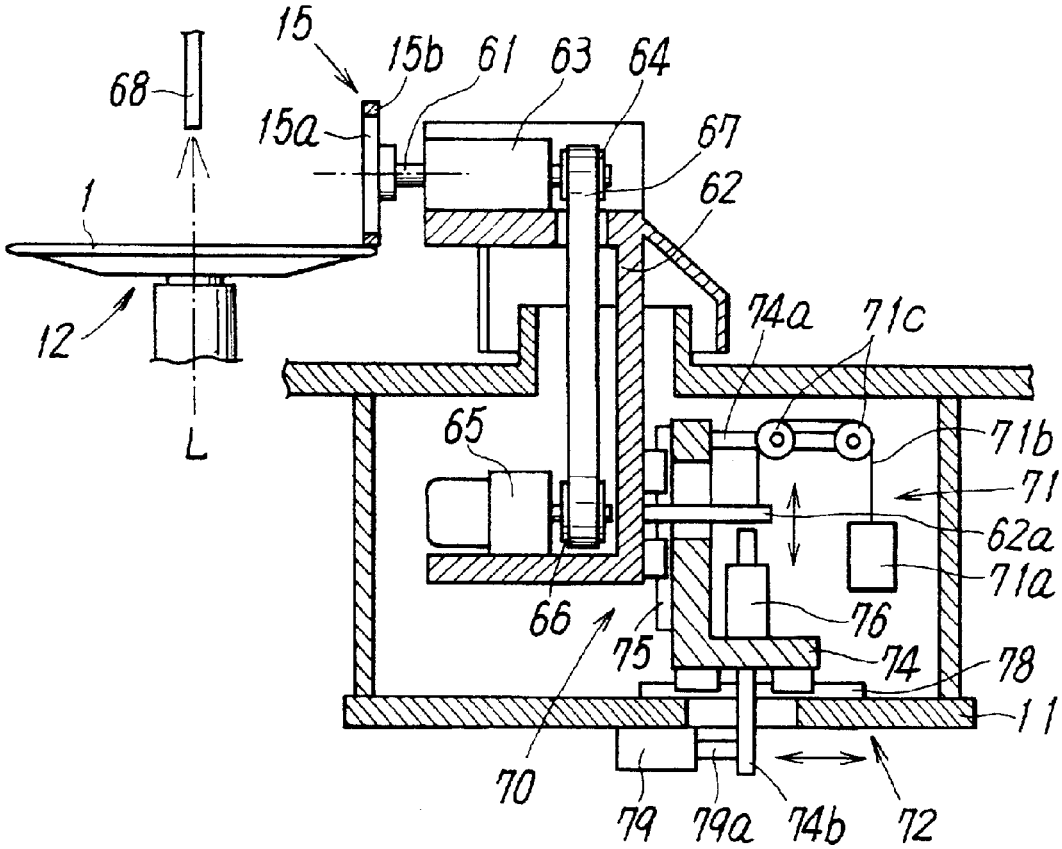
FIG. 4 is a sectional view of a peripheral-edge-polishing system along line IV—IV shown in FIG. 1.
Figure 5:
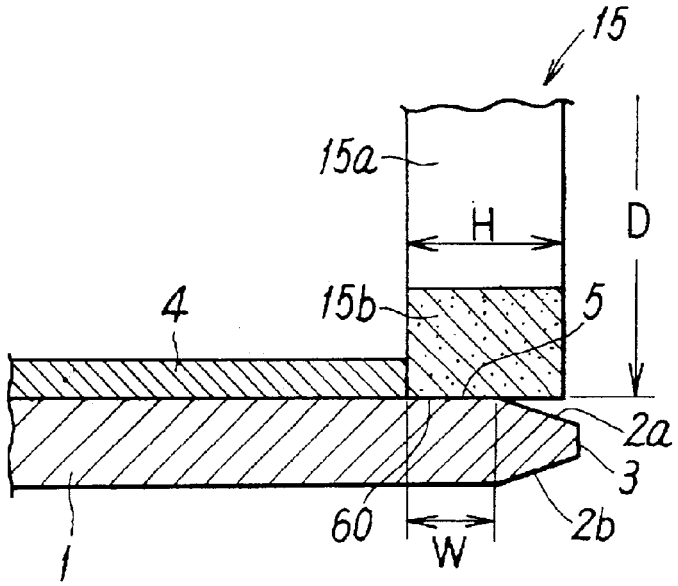
FIG. 5 is an expanded sectional view of a critical portion of the peripheral-edge-polishing system shown in FIG. 4.

In FIGS. 4 and 5, the peripheral-edge-polishing member 15 includes a work face 60 formed as a short cylinder. The work face 60 is formed such that a disc-shaped substrate 15*a* is provided with a pad 15*b* mounted around the periphery of the substrate 15*a*. The cylindrical work face 60 has a uniform diameter D and a length H in the axial direction of the cylindrical work face 60. The polishing member 15 opposes the peripheral-face-polishing member 14 with the wafer 1 therebetween. The polishing member 15 is positioned such that a rotary shaft 61 of the polishing member 15 is disposed perpendicular to the axis L of the wafer 1, the work face 60 comes into planar contact with the surface of a front face-peripheral-edge 5 of the wafer 1, and the rotary shaft 61 is rotatably supported by a bearing 63 mounted on a supporting frame 62. A pulley 64 is fixed to an end of the rotary shaft 61. A timing belt 67 is mounted on the pulley 64 and a pulley 66 of a driving motor 65 which is mounted on the supporting frame 62, whereby the polishing member 15 can be driven for rotation in both directions by the motor 65.

The peripheral-edge-polishing member 15 is provided with a first guide mechanism 70 for supporting the polishing member 15 movable in a direction along the axis L of the wafer 1, that is, in a direction toward or away from the wafer 1, a load-applying mechanism 71 for controlling the polishing load so that the polishing member 15 is pressed onto the wafer 1 during polishing at a predetermined pressure, and a second guide mechanism 72 for supporting the polishing member 15 movable in a radial direction of the wafer 1.

The first guide mechanism 70 includes a rail 75 provided on a supporting table 74 and the supporting frame 62 movable on the rail 75 in a direction along the axis L of the wafer 1. A weight 71*a* forming the load-applying mechanism 71 is connected, via a wire 71*b*, to an end of an arm 62*a* extending from the supporting frame 62. The load of the weight 71*a* is upward applied to the supporting frame 62 with the wire 71*b* being mounted on pulleys 71*c* which are supported by a first arm 74*a* extending from the supporting table 74. The sum of the load of the supporting frame 62 and all components mounted thereto is partly offset by the weight 71*a*, and the peripheral-edge-polishing member 15 is brought into contact with the wafer 1 at a predetermined pressure which equals the remaining load. For example, when the polishing load is set to 2 kg and the total load of the supporting frame 62 is 10 kg, the weight 71*a* having a weight of 8 kg is used.

Numeral 76 shown in the drawing represents a driving unit for separating the peripheral-edge-polishing member 15 from the wafer 1 by pressing the arm 74*a*, the driving unit 76 being formed with an air cylinder.

The second guide mechanism 72 includes a rail 78 mounted on the apparatus body 11, the supporting table 74 movable along the rail 78 in a radial direction of the wafer 1, and a driving unit 79 for moving the supporting table 74 forward and backward. The driving unit 79 is formed with an air cylinder, and a rod 79*a* of the driving unit 79 is connected to a second arm 74*b* which extends from the supporting table 74. However, the driving unit 79 may be formed with a motor, a ball screw to be rotated in both directions by the motor, and a nut mounted to the above-described arm and coupled with the ball screw, instead of the air cylinder.

The wafer 1 is polished by the polishing apparatus described above at the periphery of the wafer 1 in such a manner as described below. That is, the wafer 1 is firstly supplied to the chuck unit 12 by using an appropriate loading unit and is chucked by the chuck unit 12.

Next, the wafer 1 is rotated about the axis L thereof by the chuck unit 12 at a predetermined speed, for example, in the order of 1000 rpm, and the polishing members 13*a*, 13*b*, 14, and 15 are brought into contact with the corresponding portions of the periphery of the wafer 1 deposited with the metallic film 4 thereon to be polished. That is, the respective arc-shaped work faces 22 of the first and second inclined-face-polishing members 13*a* and 13*b* are brought into line-contact with the inclined faces 2*a* and 2*b*, respectively, disposed at both sides of the wafer, the arc-shaped work face 42 of the peripheral-face-polishing member 14 is brought into line-contact with the peripheral face 3, and the peripheral-edge-polishing member 15 rotating at a predetermined speed, for example, in the order of 1 rpm is brought into planar contact with the surface of the front-face-peripheral-edge 5 at the work face 60 disposed at the periphery of the peripheral-edge-polishing member 15. Thus, the inclined-face-polishing members 13*a* and 13*b*, the peripheral-face-polishing member 14, and the peripheral-edge-polishing member 15 simultaneously polish the inclined faces 2*a* and 2*b*, the peripheral face 3, and the front-face-peripheral-edge 5, respectively, whereby an unnecessary part of the metallic film 4 is removed from the periphery of the wafer 1. In this case, a width W of the metallic film 4 to be removed from the edge of the front face of the wafer 1 can be freely set by moving the peripheral-edge-polishing member 15 in the radial direction of the wafer 1 by using the second guide mechanism 72.

Thus, an unnecessary part of the metallic film 4 disposed at the periphery of the wafer 1 which is held by the chuck unit 12 can be removed easily and reliably by once chucking in one process stage and by polishing the part from which the metallic film 4 is removed by using the inclined-face-polishing members 13*a* and 13*b*, the peripheral-face-polishing member 14, and the peripheral-edge-polishing member 15, whereby damages due to chucking a plurality of times can be avoided. The inclined-face-polishing members 13*a* and 13*b* and the peripheral-face-polishing member 14 are provided with the arc-shaped work faces 22 and 42, respectively, which come into line-contact with the inclined faces 2*a* and 2*b* and the peripheral face 3, respectively, for polishing. Therefore, the polishing can be performed efficiently and in a short time. The end of the metallic film 4 can be polished and formed perpendicularly by the work face 60 of the peripheral-edge-polishing member 15 coming into planar contact with the front-face-peripheral-edge 5.

When the wafer 1 is polished, polishing slurry is supplied to the wafer 1 through a nozzle 68, as typically shown in FIG. 4.

Figure 6:
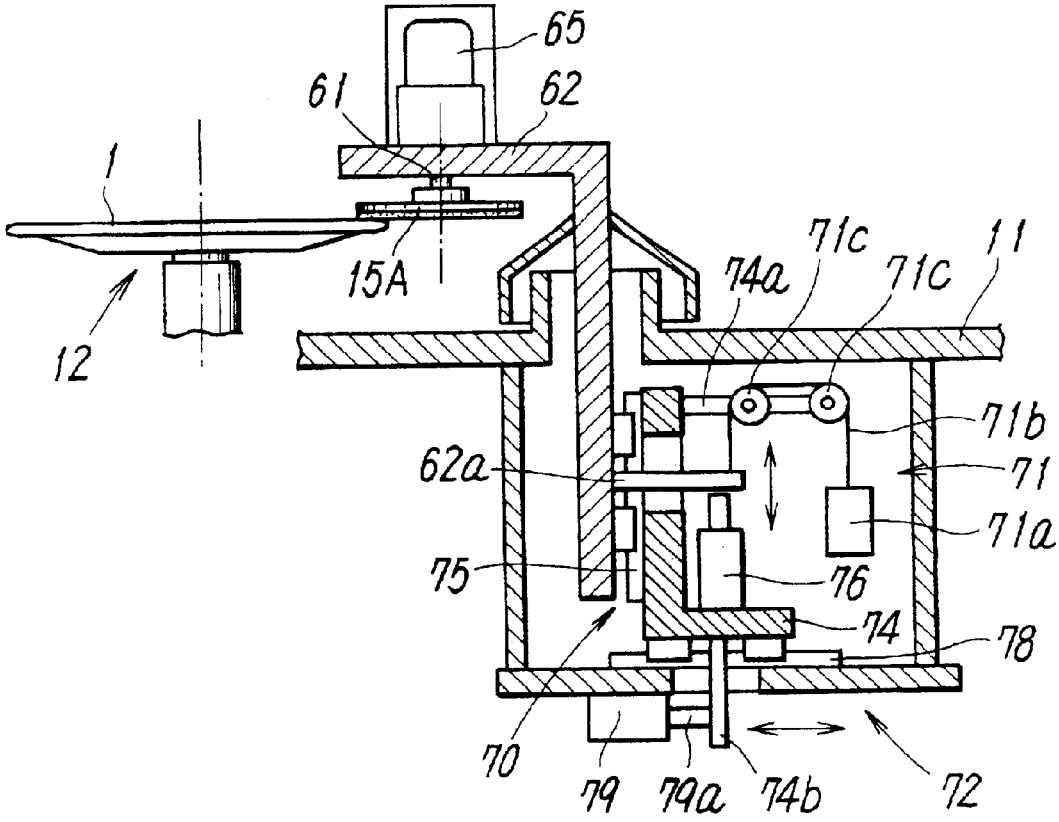
FIG. 6 is a sectional view of a peripheral-edge-polishing system according to a second embodiment, from the same position as that for the view shown in FIG. 4.
Figure 7:
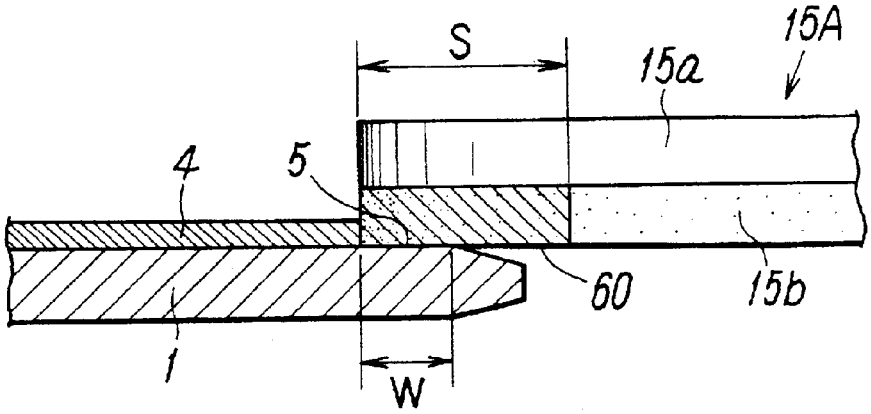
FIG. 7 is an expanded sectional view of the peripheral-edge-polishing system shown in FIG. 6.

FIG. 6 shows a peripheral-edge-polishing system according to a second embodiment. A peripheral-edge-polishing member 15A according to the second embodiment includes an annular flat work face 60 having a width S in the radial directions larger than the width W of the metallic film 4 to be removed, as shown in FIG. 7, the work face 60 being formed such that a pad 15*b* is mounted to the peripheral edge of a front face of a disc-shaped substrate 15*a*. The peripheral-edge-polishing member 15A is positioned such that a rotary shaft 61 is disposed parallel to the axis of the wafer 1 and the work face 60 comes into planar contact with the surface of the front-face-peripheral-edge 5 of the wafer 1. The rotary shaft 61 is directly connected to a motor 65. The pad 15*b* may be mounted to the overall front face of the substrate 15*a*.

The configuration other than that described above is the same as that of the peripheral-edge-polishing system according to the first embodiment, shown in FIG. 4. The same components as those according to the first embodiment are referred to by using the same reference numerals, of which the description is omitted.

Figure 8:
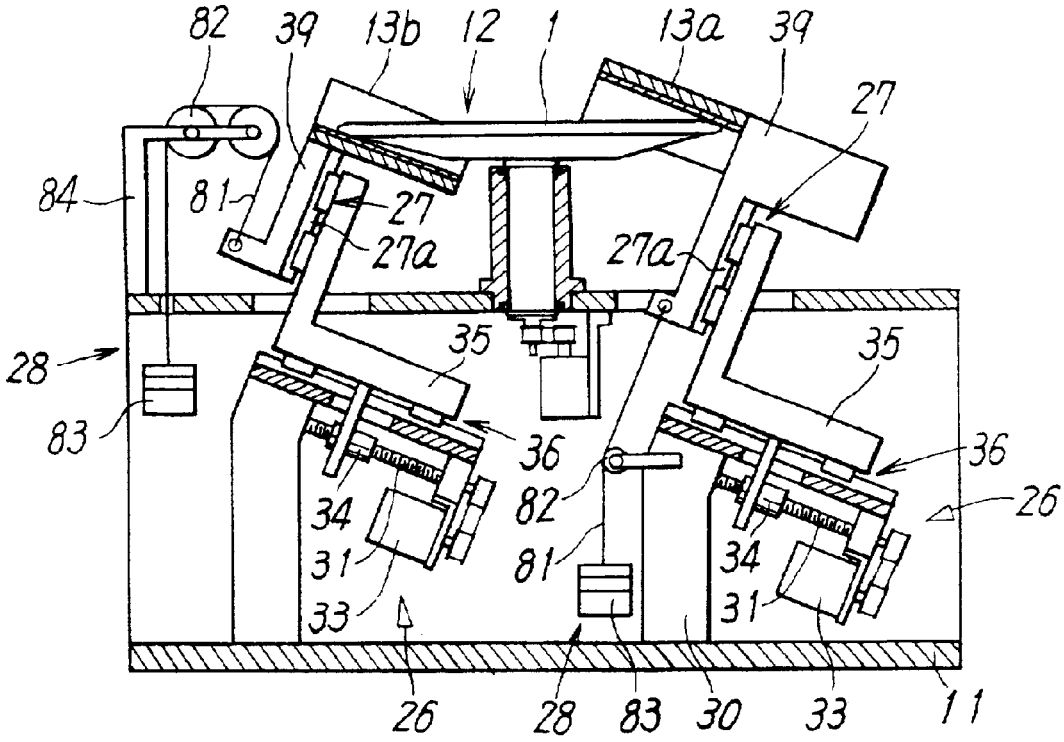
FIG. 8 is a sectional view of an inclined-face-polishing system according to the second embodiment.
Figure 9:
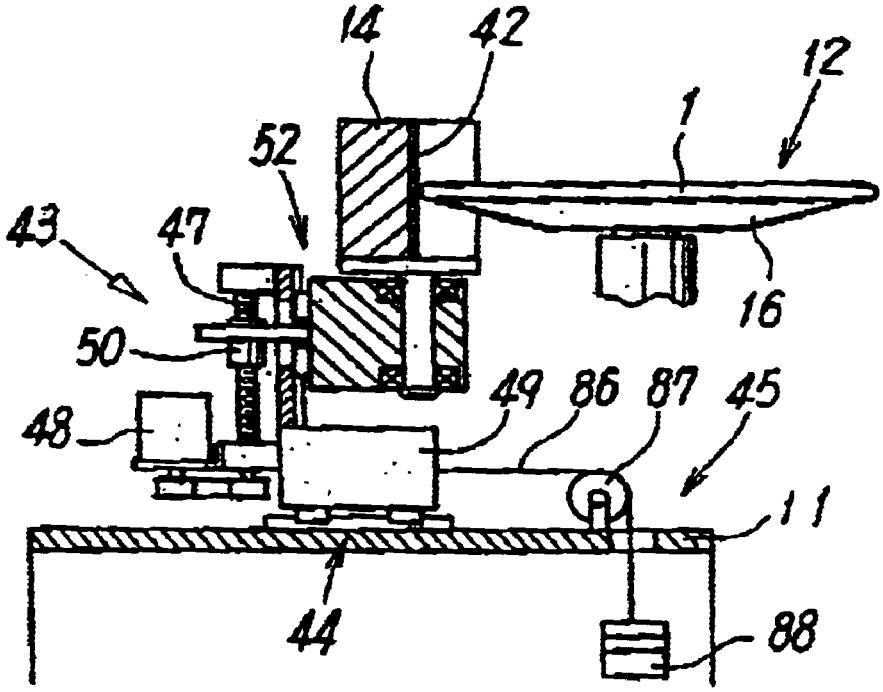
FIG. 9 is a sectional view of a peripheral-face-polishing system according to the second embodiment.

FIGS. 8 and 9 show an inclined-face-polishing system and a peripheral-face-polishing system, respectively, according to the second embodiment. The inclined-face-polishing system and the peripheral-face-polishing system individually differ from the polishing systems, respectively, according to the first embodiment shown in FIGS. 2 and 3, in that the polishing systems according to the second embodiment include load-applying mechanisms 28 and 45, respectively, which are each formed with a weight.

That is, in the load-applying mechanism 28 of the inclined-face-polishing system shown in FIG. 8, an end of a cord 81 is connected to the holder 39 for supporting the first polishing member 13*a*, and the other end of the cord 81 extends parallel to the rail 27*a* of the linear guide mechanism 27 and obliquely downward, is mounted on a pulley 82 which is mounted to the bracket 30, and downward extends in the vertical direction. A weight 83 of which the weight can be controlled is suspended from the other end of the cord 81. The polishing load of the first polishing member 13*a* is produced with the first polishing member 13*a* being urged obliquely downward along the rail 27*a* by the gravity of the weight 83. In the second polishing member 13*b*, the cord 81 connected to the holder 39 at one end of the cord 81 is led obliquely upward in parallel to the rail 27*a* of the linear guide mechanism 27, is mounted to the pulley 82 which is supported by the apparatus body 11 via a bracket 84, and extends downward. The weight 83 is suspended from the other end of the cord 81. A predetermined polishing load is applied with the second polishing member 13*b* being urged obliquely upward by the gravity of the weight 83.

In the load-applying mechanism 45 of the peripheral-face-polishing system shown in FIG. 9, an end of a cord 86 is connected to an end face of the movable table 49. The other end of the cord 86 extends in a horizontal direction toward the chuck unit 12, is mounted to a pulley 87 which is disposed on the apparatus body 11, and extends downward. A weight 88 is suspended from the other end of the cord 86. A predetermined polishing load is applied with the movable table 49 being urged toward the wafer 1 by the gravity of the weight 88.

When the load-applying mechanism 28 or 45 is formed with the weight 83 or 88, respectively, a mechanism for withdrawing the holder 39 or the movable table 49 by a predetermined distance and maintaining the same in that position is preferably provided so as to maintain the polishing member 13*a* or 13*b* or the polishing member 14 in a position separated from the wafer 1 in a non-polishing state.

The configurations of the inclined-face-polishing system and the peripheral-face-polishing system other than the configurations described above, according to the second embodiment, are substantially the same as those according to the first embodiment; therefore, major components the same as those according to the first embodiment are referred to with the same reference numerals as those used in the first embodiment, for which description is omitted.

Although according to the embodiments shown in FIGS. 4 and 6, the load-applying mechanism 71 includes the weight 71*a* for pressing the peripheral-edge-polishing member 15 or 15A onto the wafer 1, an air cylinder such as used in the inclined-face-polishing member 13*a* or 13*b* shown in FIG. 2, a torque motor, or the like may be used instead of the weight. In this case, the air cylinder or the torque motor is mounted on the supporting table 74, and a force in an upward direction is applied to the supporting frame 62 by a rod or an output shaft of the air cylinder or the torque motor, respectively.

The pad 23 bonded to the work face of each polishing member may be formed as a one-layer structure by being directly bonded to the substrate, or be formed as a two-layer structure by being bonded to the substrate via an elastic sheet such as a synthetic rubber or sponge.

The sections of the work faces of the polishing members 13*a*, 13*b*, and 14 are each not limited to the shape of an arc of a circle, and they may be each an arc other than the arc of a circle, which has, for example, a concave shape, such as a part of an ellipse.

Although the wafer 1 is chucked horizontal by the chuck unit 12 and rotates about the vertical axis L, the wafer 1 is not necessarily supported horizontal. For example, the inclined-face-polishing members 13*a* and 13*b* may be positioned with the axes thereof being disposed vertical, and the wafer 1 may be inclined with respect to the inclined-face-polishing members 13*a* and 13*b*.

According to the present invention, a device wafer deposited with a metallic film thereon can be polished in one process stage at inclined faces of the device wafer chamfered at both sides of the periphery thereof, a peripheral face between the inclined faces, and a peripheral edge of the front face of the device wafer by using independent polishing members for polishing corresponding portions of the periphery of the device wafer, whereby an unnecessary part of the metallic film disposed at the periphery of the wafer can be removed efficiently by once chucking the wafer and the perpendicular end of the metallic film is formed.

What is claimed is:

1. A polishing apparatus for polishing a periphery of a device wafer, the apparatus comprising:

a chuck table which chucks the device wafer provided with a metallic film deposited on inclined faces formed by chamfering both sides of the device wafer at the periphery thereof, a peripheral face disposed between the inclined faces, and a front face of the device wafer, and said chuck table rotates the device wafer about an axis thereof at a predetermined speed;

a first inclined-face-polishing member and a second inclined-face-polishing member each having an arc-shaped work face and an axis which is inclined with respect to said axis of the device wafer, the work face of the first inclined-face-polishing member being positioned so as to come into line-contact with the inclined face disposed at the front face of the device wafer and the work face of the second inclined-face-polishing member being positioned so as to come into line-contact with the inclined face disposed at a rear face of the device wafer;

a peripheral-face-polishing member having an arc-shaped work face and an axis which is parallel to the axis of the device wafer, said work face of said peripheral-face-polishing member being positioned so as to come into line-contact with the peripheral face of the device wafer; and a peripheral-edge-polishing member formed as a disc rotatable about an axis thereof either perpendicular or parallel to the axis of the device wafer, a work face of the peripheral-edge-polishing member being positioned so as to come into planar contact with the front face of the device wafer at a peripheral edge thereof.

2. A polishing apparatus according to claim 1, further comprising:

at least one feed mechanism for moving the first inclined-face-polishing member, at least one feed mechanism for moving the second inclined-face-polishing member, and at least one feed mechanism for moving the peripheral-face-polishing member, each in a direction parallel to the axis thereof;

at least one linear guide mechanism for supporting the first inclined-face-polishing member, at least one linear guide mechanism for supporting the second inclined-face-polishing member, and at least one linear guide mechanism for supporting the peripheral-face-polishing member, each being movable in a direction perpendicular to the axis thereof; and at least one load-applying mechanism for bringing the first inclined-face-polishing member, at least one load-applying mechanism for bringing the second inclined-face-polishing member, and at least one load-applying mechanism for bringing the peripheral-face-polishing member into contact with the device wafer, each at a predetermined pressure.

3. A polishing apparatus according to claim 1, further comprising:

a first guide mechanism for supporting the peripheral-edge-polishing member movable in directions toward and away from the device wafer;

a load-applying mechanism for bringing the peripheral-edge-polishing member into contact with the front face of the device wafer at a predetermined pressure; and a second guide mechanism for moving the peripheral-edge-polishing member in a radial direction of the device wafer so that the width of the metallic film to be removed is controlled.

4. A polishing apparatus according to claim 1, wherein the first inclined-face-polishing member and the second inclined-face-polishing member are disposed so as to oppose each other, and the peripheral-face-polishing member and the peripheral-edge-polishing member are disposed so as to oppose each other in a direction differing by ninety degrees from a direction in which the first inclined-face-polishing member and the second inclined-face-polishing member oppose each other.

5. A polishing apparatus according to claim 3, wherein the second guide mechanism for the peripheral-edge-polishing member comprises a supporting table which is movable along an apparatus body in the radial direction of the device wafer and a driving source for driving the supporting table, the first guide mechanism is formed such that the supporting table supports a supporting frame which holds the peripheral-edge-polishing member so that the supporting frame is movable in the directions toward and away from the device wafer, and the load-applying mechanism is connected to the supporting frame and functions to reduce a sum of the load of the supporting frame and components mounted thereon, thereby applying the reduced load as a work load to the device wafer.

6. A polishing apparatus according to claim 1, wherein the work face of the peripheral-edge-polishing member is provided at a periphery of the peripheral-edge-polishing member and is formed as a short cylinder which has a uniform diameter and a length in the axial direction greater than a width of the metallic film to be removed, the work fare being rotatable about the axis perpendicular to the axis of the device wafer.

7. A polishing apparatus according to claim 1, wherein the work face of the peripheral-edge-polishing member is flat, is provided on a surface of at least a peripheral edge of the peripheral-edge-polishing member, has a width in the radial direction greater than the width of the metallic film to be removed, and is rotatable about the axis parallel to the axis of the device wafer.

8. A polishing apparatus for polishing a periphery of a device wafer, the apparatus comprising:

a chuck table which chucks the device wafer provided with a metallic film deposited on inclined faces formed by chamfering both sides of the device wafer at the periphery thereof, a peripheral face disposed between the inclined faces, and a front face of the device wafer, and said chuck table rotates the device wafer about an axis thereof at a predetermined speed;

a first inclined-face-polishing member and a second inclined-face-polishing member each having an arc-shaped work face and an axis which is inclined with respect to said axis of the device wafer, the work face of the first inclined-face-polishing member being positioned so as to come into line-contact with the inclined face disposed at the front face of the device wafer and the work face of the second inclined-face-polishing member being positioned opposing the first inclined-face-polishing member so as to come into line-contact with the inclined face disposed at a rear face of the device wafer;

A peripheral-face-polishing member having an arc-shaped work face and an axis which is parallel to the axis of the device wafer, said work face of said peripheral-face-polishing member being positioned so as to come into line-contact with the peripheral face of the device wafer;

A peripheral-edge-polishing member opposing the peripheral-face-polishing member and being formed as a disc rotatable about an axis thereof either perpendicular or parallel to the axis of the device wafer, a work face of the peripheral-edge-polishing member being positioned so as to come into planar contact with the front face of the device wafer at a peripheral edge thereof;

at least one feed mechanism for moving the first inclined-face-polishing member, at least one feed mechanism for moving the second inclined-face-polishing member, and at least one feed mechanism for moving the peripheral-face-polishing member, each in a direction parallel to the axis thereof, at least one guide mechanism for supporting the first inclined-face-polishing member, at least one guide mechanism for supporting the second inclined-face-polishing member, and at least one guide mechanism for supporting the peripheral-face-polishing member, each being movable in a direction perpendicular to the axis thereof, and at least one load-applying mechanism for bringing the first inclined-face-polishing member, at least one load-applying mechanism for bringing the second inclined-face-polishing member, and at least one load-applying mechanism for bringing the peripheral-face-polishing member into contact with the device wafer, each at a predetermined pressure; and a first guide mechanism for supporting the peripheral-edge-polishing member movable in directions toward and away from the device wafer, a load-applying mechanism for bringing the peripheral-edge-polishing member into contact with the front face of the device wafer at a predetermined pressure, a second guide mechanism for moving the peripheral-edge-polishing member in a radial direction of the device wafer so that the width of the metallic film to be removed is controlled, and a driving source.

9. A polishing apparatus according to claim 8, wherein the work face of the peripheral-edge-polishing member is provided at a periphery of the peripheral-edge-polishing member and is formed as a short cylinder which has a uniform diameter and a length in the axial direction greater than the a width of the metallic film to be removed, the work face being rotatable about the axis perpendicular to the axis of the device wafer.

10. A polishing apparatus according to claim 8, wherein the work face of the peripheral-edge-polishing member is flat, is provided on a surface of at least a peripheral edge of the peripheral-edge-polishing member, has a width in the radial direction greater than the width of the metallic film to be removed, and is rotatable about the axis parallel to the axis of the device wafer.

11. A method for polishing a periphery of a device wafer, the method comprising the steps of:

chucking and rotating the device wafer about an axis thereof at a predetermined speed, the device wafer being provided with a metallic film deposited on inclined faces formed by chamfering both sides of the device wafer at a periphery thereof, a peripheral face disposed between the inclined faces, and a front face of the device wafer;

bringing an arc-shaped work face of a first inclined-face-polishing member into line-contact with the inclined face disposed at the front face of the device wafer and an arc-shaped work face of a second inclined-face-polishing member into line-contact with the inclined face disposed at a rear face of the device wafer, the first and second inclined-face-polishing members being each inclined with respect to the axis of the device wafer;

bringing an arc-shaped work face of a peripheral-face-polishing member into line-contact with the peripheral face of the device wafer, the peripheral-face-polishing member being parallel to the axis of the device wafer; and bringing a work face of a peripheral-edge-polishing member into planar contact with the front face of the device wafer at a peripheral edge thereof, the peripheral-edge-polishing member rotating about an axis thereof either perpendicular or parallel to the axis of the device wafer, wherein the inclined faces, the peripheral face, and the peripheral edge of the device wafer are polished simultaneously by the respective polishing members, whereby an unnecessary part of the metallic film is removed from the periphery of the device wafer.

* * * * *